United States Patent [19]

Lingenfelter et al.

[11] 4,140,174

[45] Feb. 20, 1979

[54] RADIATOR ASSEMBLY FOR FLUID FILLED ELECTRICAL APPARATUS

[75] Inventors: Robert C. Lingenfelter; James J. Kunes, both of Hermitage; Peter T. Narbut, Sharon; Rom M. Bellisario, Hermitage, all of Pa.

[73] Assignee: Westinghouse Electric Corp., Pittsburgh, Pa.

[21] Appl. No.: 846,941

[22] Filed: Oct. 31, 1977

[51] Int. Cl.[2] ..... F28D 15/00

[52] U.S. Cl. ..... 165/106; 165/175; 29/157.3 R

[58] Field of Search ..... 165/106, 108, 148, 175; 29/157.3 R

[56] References Cited

U.S. PATENT DOCUMENTS

| | | | |
|---|---|---|---|
| 1,064,849 | 6/1913 | Monnot | 165/106 |
| 1,619,334 | 3/1927 | Dann | 165/106 |
| 1,739,671 | 12/1929 | Higgins | 165/148 |
| 1,999,246 | 4/1935 | Maret | 165/134 |
| 3,506,064 | 4/1970 | Appleyard et al. | 165/106 |
| 3,650,321 | 3/1972 | Kaltz | 165/106 |
| 4,019,572 | 4/1977 | Harlan et al. | 165/106 |

*Primary Examiner*—Edgar W. Geoghegan
*Attorney, Agent, or Firm*—D. R. Lackey

[57] ABSTRACT

A radiator assembly having a plurality of radiator sections, each formed of two mated panels with individual header sections extending through upper and lower apertures therein. The individual header sections are joined to the corresponding header sections of adjoining radiator sections to form a continuous header assembly.

7 Claims, 4 Drawing Figures

RADIATOR ASSEMBLY FOR FLUID FILLED ELECTRICAL APPARATUS

BACKGROUND OF THE INVENTION

1. Field of the Invention:

This invention relates, in general, to heat exchangers and, more specifically, to radiator assemblies for fluid-filled electrical apparatus.

2. Description of the Prior Art:

Radiator assemblies for fluid-filled electrical apparatus have been constructed in many different shapes and arrangements. Some of the most efficient arrangements use sheet metal panels which are formed and welded together to provide ducts through which the liquid coolant flows. Several of these two-panel combinations, or radiator sections, are joined together in fluid communication by header assemblies which are connected to the electrical apparatus enclosure.

One widely-used prior art radiator arrangement uses a plurality of radiator sections, each with openings at their top and bottom ends, which, when connected to a simple header assembly, permit the flow of coolant through ducts in the radiator sections. A considerable number of welded or brazed joints are necessary on each section to form a liquid-tight seal with each header assembly. These joints require a considerable amount of labor expense and are regarded as possible locations of failure and fluid leakage. However, the solid tube or pipe used to form each header assembly provides sufficient cantilever strength to support the radiator assembly and the coolant contained therein.

Another common type of radiator assembly uses a so-called "integral header" construction. As shown in U.S. Pat. Nos. 4,019,572; 3,650,312; 3,506,064; 1,999,246; and 1,619,334, the radiator assembly includes a plurality of radiator sections which are connected together by flanges extending from the metal panels which form each radiator section. The flanges are formed into these panels and are dimensioned to allow the flanges to telescope together to form a header for the radiator assembly. Although the integral header construction simplifies assembly of the radiators and provides a reliable fluid-tight joint, additional support and bracing is necessary to support the weight of the radiator assembly and coolant because thin sheet metal is used to form the metal panels. In addition, the severe forces encountered during shipping of such apparatus prohibit integral header radiator assemblies from being shipped in place on the tank wall, thereby necessitating their removal after final testing. Besides additional bracing and support, integral headers still require considerable labor since all of the external welds must be done manually because automatic welding equipment cannot pass through the space between radiator sections.

Thus, it would be desirable to provide a radiator assembly for fluid-filled electrical apparatus having a construction that permits automatic joining equipment to be used in assembling the header and radiator sections. It would also be desirable to provide a radiator assembly having a header construction that provides sufficient support so that additional bracing of the radiator assembly is not required, and would, also, enable the radiator assembly to be mounted and shipped in place on the tank of the electrical apparatus.

SUMMARY OF THE INVENTION

There is disclosed herein a new and improved radiator assembly that can be completely constructed by automatic joining equipment and, also, has sufficient inherent strength that additional bracing to support the weight of the radiator assembly and coolant contained therein is not required. The radiator assembly includes a plurality of radiator sections, each formed of sheet metal panels having upper and lower apertures and corrugated surfaces which are joined together to form a fluid flow path therebetween. Upper and lower header sections extend through the upper and lower apertures and are joined to the panels and, further, contain openings therein which dispose the header sections in fluid flow communication with each radiator section. The ends of the header sections are joined to the header sections of adjoining radiator sections to form continuous upper and lower header assemblies that establish a fluid flow path for coolant fluid from the tank of an electrical apparatus through the upper header, into the radiator sections, and back through the lower header to the tank.

The unique configuration of the radiator and header sections enables the joining of the headers to each radiator section panel and to adjoining headers to be accomplished by automatic equipment, thereby reducing labor expense and insuring a reliable fluid-tight joint. Furthermore, the large wall thickness of the header sections compared to the relatively thin sheet metal used to form the radiator sections provides sufficient cantilever strength to support the radiator assemblies and the coolant contained therein without the need of additional bracing as normally required in prior art type integral header radiator assemblies. Also, the header sections provide sufficient strength to withstand the severe forces encountered during shipping of such apparatus, thereby enabling the radiator assembly to be mounted and shipped in place on the tank of the electrical apparatus which reduces installation cost at the customer site.

BRIEF DESCRIPTION OF THE DRAWING

The various features, advantages and other uses of this invention will become more apparent by referring to the following detailed description and drawing in which.

DESCRIPTION OF THE PREFERRED EMBODIMENTS

Figure 1:
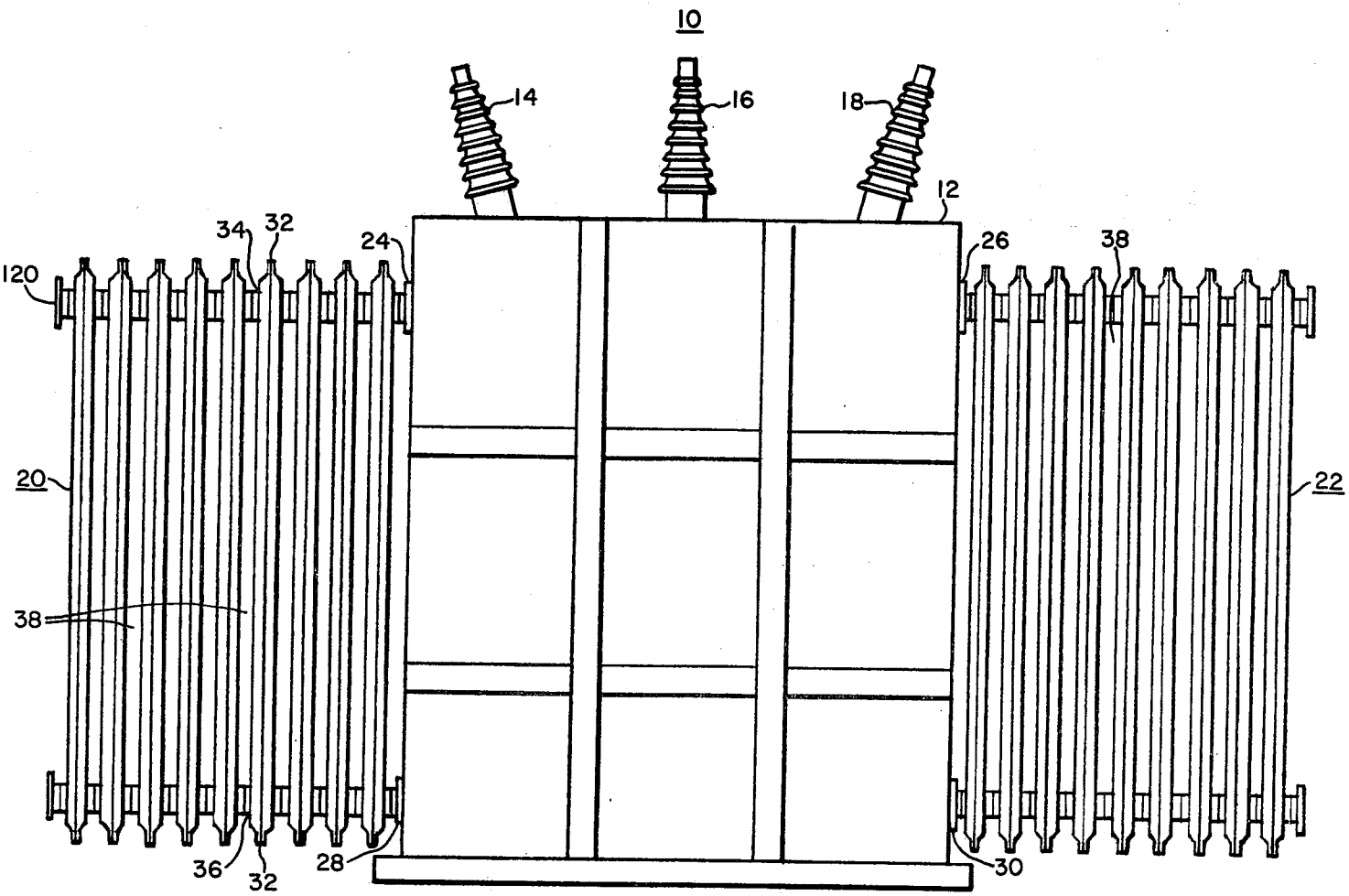
FIG. 1 is an elevational view of an electrical transformer having attached thereto radiator assemblies constructed according to the teachings of this invention.

Throughout the following description, identical reference numbers refer to the same element or component in all figures of the drawing.

Referring now to the drawing, and to FIG. 1 in particular, there is shown an electrical apparatus 10, such as a power transformer, constructed according to the teachings of this invention. The transformer tank 12 encloses the magnetic core and electrical winding assembly of the transformer and contains a fluid dielectric, such as mineral oil, which cools the core and winding assembly. Electrical bushings 14, 16, and 18 are attached to the top of the transformer tank 12 and provide means for connecting the enclosed windings to an external electrical circuit.

The transformer 10 includes radiator assemblies 20 and 22 which are connected on each side of the tank 12 and permit the flow of fluid coolant from the tank 12 through mounting flanges 24 and 26, through the radiator assemblies, 20 and 22, through the mounting flanges 28 and 30, respectively, and back to the tank 12. The construction illustrated is arranged for fluid circulation caused primarily by the differences in densities of fluids having different temperatures. In another arrangement using the apparatus of this invention, forced flow of the fluid coolant may be produced by inserting fluid pumps at appropriate positions in the flow path, such as near the flanges 28 and 30.

Each radiator assembly 20 and 22 includes a plurality of radiator sections, such as radiator section 32 of the radiator assembly 20. Each radiator section includes upper and lower header sections, such as upper and lower header sections 34 and 36, respectively, for radiator section 32, which are connected to corresponding upper and lower header sections of adjoining radiator sections to form a closed fluid path.

An air space 38 exists between each radiator section for the purpose of allowing the circulation of air between the sections to dissipate the heat transferred to the radiator sections from the hot fluid coolant flowing therein. In some applications, the movement of the air between the radiator sections may be increased by placing fans adjacent to the radiator assemblies. In general, the ability of the radiator sections to transfer heat from the fluid coolant to the surrounding air is improved by increasing the rate of flow of the air across and between the radiator sections.

Figure 4:
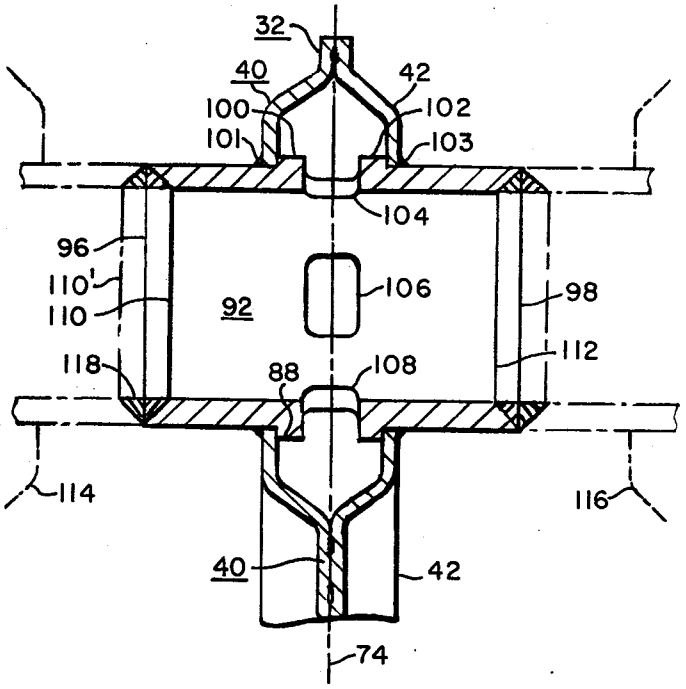
FIG. 4 is a sectional view, generally taken along line IV—IV of FIG. 2.
Figure 2:
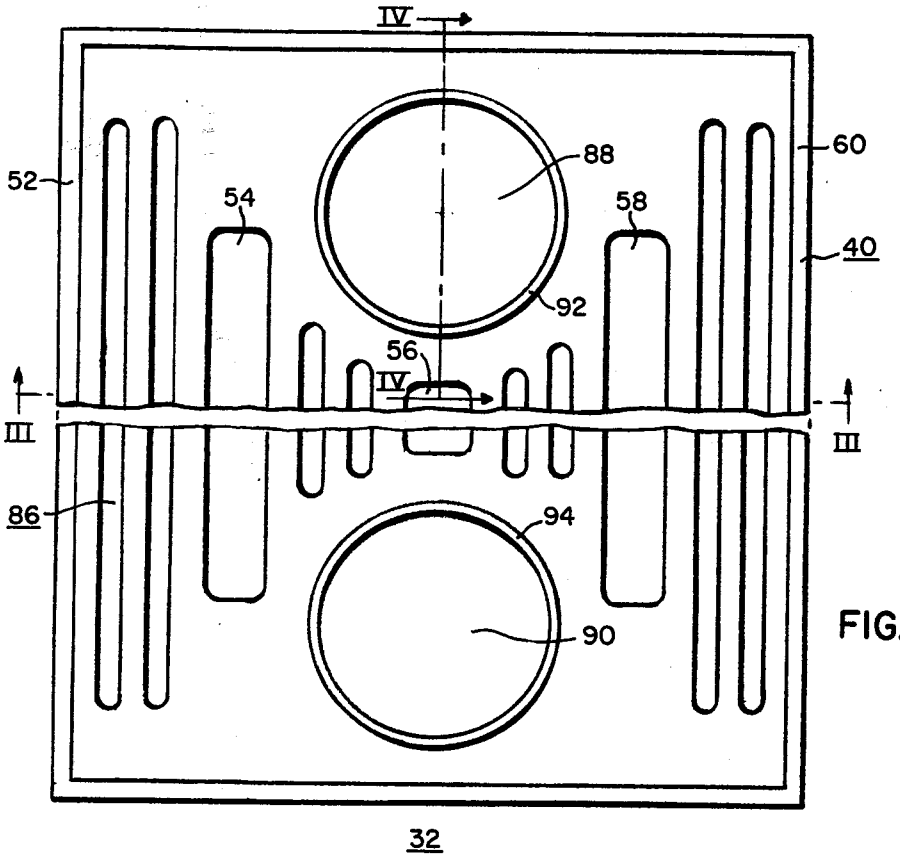
FIG. 2 is an elevational view of a radiator section constructed according to the teachings of this invention.
Figure 3:
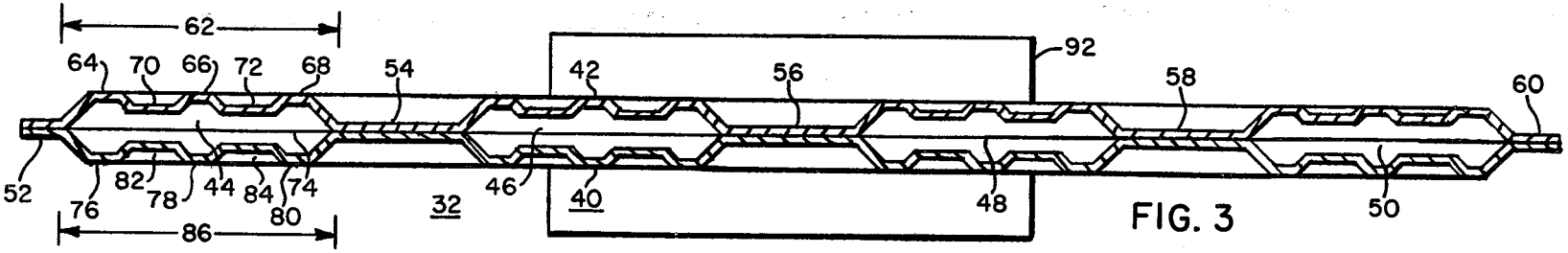
FIG. 3 is a sectional view, generally taken along line III—III of FIG. 2.

Referring now to FIGS. 2, 3, and 4, there is shown the detailed construction of one of the identical radiator sections, such as radiator section 32. According to the preferred embodiment of this invention, radiator section 32 is constructed of identical first and second panels 40 and 42 which are cut from thin sheet steel into a rectangular form. The first and second panels 40 and 42 are placed in inverted mating relationship and joined together by suitable means, such as by seam welding, at their peripheral edges to form a fluid-tight assembly.

FIGS. 2 and 3 illustrate the arrangement and shape of the ducts 44, 46, 48, and 50 which extend through the radiator section 32. The panels 40 and 42 are welded together at positions 52, 54, 56, 58 and 60 by seam welds which extend substantially from the top to the bottom of the panels. The corrugated surfaces which define the ducts have definite shapes and dimensions to provide an efficient heat transfer system. In an arrangement which has been found to be highly efficient, each corrugated surface includes a series of ridges and furrows pressed into the sheet steel panel which are alternately positioned across the corrugated surface. For example, the corrugated surface 62 in panel 42, shown in FIG. 3, includes the ridges 64, 66, and 68 and the furrows 70 and 72. Ridges are characterized as extending away from the plane of intersection 74 between the panels 40 and 42. Furrows, on the other hand, are characterized as extending toward the plane of intersection 74 between the panels 40 and 42. Thus, the panel 40 includes, among others, the ridges 76, 78 and 80 and the furrows 82 and 84. The identical panels 40 and 42 are assembled in inverted mating relationship such that the ridges and furrows of one panel are aligned or situated directly across from the corresponding ridges and furrows of the adjoining panel thereby forming vertically-extending ducts therebetween, such as duct 44 formed between the corrugated surfaces 62 and 86 of the panels 42 and 40, respectively. The coolant flowing through the ducts transfers heat to the corrugated surfaces which define the ducts and thence to the air flowing across the corrugated surfaces.

In addition to the corrugated surfaces, the panels 40 and 42 further include first and second substantially round openings, such as openings 88 and 90 of panel 40, FIG. 2, which are situated adjacent the top and bottom ends of the panel. The openings which are co-axially aligned when the panels 40 and 42 are joined together provide means for connecting the individual header sections to each radiator section and thereby form the fluid flow path between the top and bottom ends of the radiator assembly.

Each radiator section includes first and second header sections, such as header sections 92 and 94 of radiator section 32 shown in FIG. 2. Since the first and second header section of each radiator sections are identically constructed, only the first header section 92 associated with radiator section 32 will be described in detail hereafter; it being understood that the header sections of adjoining radiator sections as well as the lower header section of radiator section 32 are similarly constructed. As seen in FIG. 4, the first or upper header section 92 is cut from round tubing or pipe having a wall thickness substantially larger than the thickness of panels 40 and 42 machined to the desired configuration. The upper header section 92 is disposed within the first aperture or opening 88 of the radiator section 32 such that first and second ends 96 and 98 extend outwardly from the first and second panels 40 and 42, respectively, of the radiator section 32. The header section 92 includes first and second annular, spaced-apart, peripheral shoulders 100 and 102, respectively. The first and second shoulders 100 and 102 are formed on the outer surface of the header section 92 to determine the axial extent to which the ends 96 and 98 of header section 92 extend from the panels 40 and 42. The shoulders 100 and 102 are positioned so as to be in registry with the inner surfaces of the first and second panels 40 and 42 of the radiator section 32 when the header section 92 is inserted within said radiator section, thereby maintaining the header section 92 in position with respect to the radiator section 32 and providing a strong joint between header section 92 and the first and second panels 40 and 42. Suitable joining means, such as an external circular fillet weld, may be deposited to form a fluid-tight joint between the upper header section 92 and each panel 40 and 42 of the radiator section 32 at the location where the header section 92 extends through the upper opening 88 in radiator section 32.

Slots, such as slots 104, 106, and 108, are machined into the upper header section 92 between the first and second shoulders 100 and 102 to dispose the upper header section 92 in fluid flow communication with the radiator section 32 such that coolant fluid will flow through the slots 104, 106 and 108 of the upper header section 92 into the ducts formed by the corrugations in the surfaces of the first and second panels 40 and 42 of the radiator section 32.

The ends 96 and 98 of the upper header section 92 are machined to form a recessed edge or surface, such as edges 110 and 112, which provide means for joining successive header sections together to form the header assembly. When the upper header assembly 92 of the radiator section 32 is joined to the upper header section of the adjoining radiator section, such as radiator section 114 partially shown in phantom in FIG. 4, the recessed edges, such as edges 110 and 110' form a groove therebetween wherein suitable joining means 118, such as an internal weld, may be disposed to strongly join adjacent header sections together.

The advantages afforded by the unique configuration of the above-described radiator section will be more clearly understood with reference to the following sequence or method of assembling an individual radiator section, such as radiator section 32, and a complete radiator assembly, such as radiator assembly 20. Initially, the upper and lower header sections 92 and 94 are inserted into the respective openings 88 and 90 in one of the panels, such as panel 40, of radiator section 32 until the annular shoulder 100 on the header sections rests on the inner surface of the first panel 40. The other identical panel 42 is then placed in inverted mating relationship with the first panel 40 with the other end of the header sections 92 and 94 extending through corresponding apertures 88 and 90 of the second panel 42. At this time, the inner surface of the second panel 42 will rest against the second shoulders of the header sections, such as second shoulder 102 of upper header section 92. The first and second panels 40 and 42 are then joined together by seam welds at locations 52, 54, 56, 58 and 60, FIG. 2, to form a fluid-tight joint between the first and second panels 40 and 42 and, also, to form the vertically extending ducts. The upper and lower header sections 92 and 94 are then joined to the first and second panels 40 and 42 by circular fillet welds at the joint between the outer surface of the header sections and the portion of the first and second panels 40 and 42 adjoining the first and second apertures 88 and 90, as illustrated by fillet welds 101 and 103 between the upper header section 92 and the first and second panels 40 and 42 of the radiator section 32 in FIG. 4.

A complete radiator assembly may thus be constructed by successively joining together individual radiator sections constructed as described above. In constructing the complete radiator assembly, the upper and lower header sections of each radiator section are aligned along respective common axes and joined together by internal fillet welds at the groove formed by the machined edges at the ends of the adjoining header sections.

As shown in FIG. 1, an end cap, such as end cap 120, is welded or brazed to the last header section of the outermost radiator section to terminate the radiator assembly. The end cap 120 may also include a short section of header pipe, a flange, and a filling plug, not shown, which may be used to add or remove coolant fluid from the radiator assembly. The opposite ends of the radiator assembly may be connected to the tank 12 of the transformer 10 by mounting flanges, such as mounting flange 24 for radiator assembly 20. The mounting flange 24 is welded to a short section of header pipe, which in turn is welded to the outer surface of the first header section. It includes bolts, not shown, which are used for connecting the radiator assembly to a flange on the transformer tank 12. In addition, a suitable gasket would normally be placed between the flange 24 and the corresponding flange on the transformer tank 12. Where shipping clearances permit the radiator assemblies to be mounted and shipped in place on the tank 12 of the transformer 10, the radiator assembly may be directly welded to the tank 12 without the use of the mounting flanges 24, 26, 28 and 30.

It will be apparent to one skilled in the art that the novel radiator assembly described above offers substantially reduced labor construction costs over prior art radiator assemblies since all of the welds, such as the welds between the mating panels of each radiator section, the welds between the header sections and each panel and adjoining header sections, may be completed by automatic welding equipment. The extensive use of manual welding necessary to construct prior art type integral header radiator assemblies is eliminated, which not only reduces the cost of the radiator assembly but also results in a more reliable fluid-tight construction. In particular, the use of round individual header sections associated with and joined to each radiator section of the radiator assembly enables the radiator assembly to be built up by successively joining the welded radiator sections to each other, one at a time, by internally welding adjoining header sections together with automatic welding equipment, which overcomes the problem associated with prior art type radiator assemblies wherein the close spacing between adjoining radiator sections prohibited the passing of the automatic equipment therethrough.

The joining of relatively thick walled header sections together to form a continuous, solid header assembly produces a header assembly with sufficient cantilever strength that eliminates the need for additional support and bracing necessary with prior art type integral header radiator assemblies formed of relatively thin sheet metal. In addition, the strength of the joined header sections is sufficient to withstand the severe forces encountered during shipping of apparatus of this type which enables the radiator assemblies to be mounted and shipped in place on the tank of the electrical apparatus. Thus, the radiator assemblies need not be removed from the tank of the electrical apparatus at the completion of the assembly and testing of the transformer which, accordingly, simplifies the installation of the transformer at the customer site.

The novel radiator assembly described above also enables maximum heat exchanger performance to be obtained per unit volume or per unit of surface area since the length of the individual header sections may be easily varied in order to maximize heat exchange. Furthermore, since each radiator section is successively joined to other radiator sections, the minimum space limitation between adjoining radiator sections, necessary with prior art type radiator designs which required a certain distance between adjoining radiator sections for manual arc welding equipment to pass through, is overcome.

We claim:

1. A radiator assembly for fluid-filled electrical apparatus, comprising:

a plurality of radiator sections, each consisting of first and second panels;

each of said first and second panels having top and bottom ends with first and second apertures located adjacent thereto, respectively, said first and second panels being disposed in mating relationship with said first and second apertures of one of said first and second panels being co-axially aligned with the corresponding first and second apertures of said other of said first and second panels, said first and second panels being joined together at least at their peripheral edges to form a fluid flow path between said top and bottom ends thereof;

each of said radiator sections further including first and second header sections disposed within and extending through said co-axially aligned first and second apertures at said top and bottom ends, respectively, of said first and second panels;

means joining said first and second header sections of each of said radiator sections to said first and second panels in fluid tight relation;

each of said first and second header sections having first and second ends extending axially from said first and second panels, respectively;

means joining said first and second ends of both of said first and second header sections to the corresponding second and first ends of the first and second header sections of adjacent radiator sections in fluid tight relation to form continuous header assemblies connecting said radiator sections in fluid flow communication; and means for connecting said header assemblies to said electrical apparatus.

2. The radiator assembly of claim 1 wherein each of the first and second header sections has a tubular cross-section with a wall thickness substantially larger than the thickness of the first and second panels of each radiator section.

3. The radiator assembly of claim 1 wherein the means for joining the first and second header sections to the first and second panels of each radiator section includes external welds disposed between said first and second header sections and the periphery of the first and second apertures, in said first and second panels.

4. The radiator assembly of claim 1 wherein the means for joining the ends of adjacent first and second header sections together includes an internal weld between the ends of adjacent co-axial first and second header sections.

5. The radiator assembly of claim 4 wherein each of the first and second ends of both of the first and second header sections includes a recessed surface which cooperates with the recessed surface on the corresponding end of the adjacent first and second header sections to form a groove therebetween wherein the internal weld, for joining said adjacent header sections together, is disposed.

6. The radiator assembly of claim 1 wherein each of the first and second header sections includes first and second annular, spaced-apart, peripheral shoulders, said first and second shoulders abutting said first and second panels, respectively, and determining the axial extent to which the respective first and second ends of both of said first and second header sections extend from said first and second panels.

7. A method of constructing a radiator assembly for fluid-filled electrical apparatus comprising the steps of:

providing a plurality of radiator sections, each having first and second panels with first and second apertures disposed adjacent top and bottom ends thereof;

inserting first and second tubular header sections, each having first and second annular, spaced-apart peripheral shoulders disposed between the ends thereof, into said first and second apertures of one of said first and second panels, respectively, until one of said first and second shoulders of each of said first and second header sections is disposed in registry with said one of said first and second panels, with one end of said first and second header sections extending through said first and second apertures, respectively;

placing the other of said first and second panels in mating relationship with said one of said first and second panels such that the other end of both of said first and second header sections extends through said first and second apertures in said other of said first and second panels, and said other shoulder of both of said first and second header sections is disposed in registry with said other of said first and second panels;

joining said first and second panels together at their peripheral edges to form a fluid flow path between said top and bottom ends thereof;

externally joining said first and second header sections to said first and second panels of said radiator section in the region of said first and second apertures on both of said first and second panels;

co-axially aligning the ends of said first and second header sections associated with one of said radiator sections with the corresponding ends of the first and second header sections of another of said radiator sections; and internally joining said ends of said first and second header sections to said corresponding ends of said first and second header sections of said another radiator section to form a fluid flow path between said radiator sections.

* * * * *